US008201725B2

(12) United States Patent
Dyer

(10) Patent No.: US 8,201,725 B2
(45) Date of Patent: Jun. 19, 2012

(54) MAILER FORMS FOR FORMING OUTGOING MAILERS HAVING AN INTEGRATED RETURN MAIL PIECE

(75) Inventor: Michael Clark Dyer, Irvine, CA (US)

(73) Assignee: Moore Wallace North America, Inc., Stamford, CT (US)

( * ) Notice: Subject to any disclaimer, the term of this patent is extended or adjusted under 35 U.S.C. 154(b) by 614 days.

(21) Appl. No.: 12/363,382

(22) Filed: Jan. 30, 2009

(65) Prior Publication Data

US 2010/0193581 A1 Aug. 5, 2010

(51) Int. Cl.
*B65D 27/06* (2006.01)
*B65D 27/00* (2006.01)

(52) U.S. Cl. ..... 229/305; 229/304; 229/92.1; 229/92.3

(58) Field of Classification Search ..... 229/305, 229/304, 92.1, 92.3
See application file for complete search history.

(56) References Cited

U.S. PATENT DOCUMENTS

| | | | | |
|---|---|---|---|---|
| 444,979 | A | | 1/1891 | Harrison et al. |
| 661,690 | A | | 11/1900 | Forney |
| 690,793 | A | | 1/1902 | Taylor |
| 975,737 | A | | 11/1910 | Utley |
| 1,032,648 | A | | 7/1912 | Berwick |
| 1,044,123 | A | | 11/1912 | Berwick |
| 1,472,142 | A | | 10/1923 | Shurick |
| 1,698,628 | A | | 1/1929 | Gonzales |
| 2,016,063 | A | | 11/1933 | White |
| 2,116,230 | A | | 5/1938 | Berkowitz |
| 2,129,192 | A | | 9/1938 | Berkowitz |
| 3,229,893 | A | | 1/1966 | Stein |
| 3,652,007 | A | | 3/1972 | MacDougall |
| 3,858,792 | A | * | 1/1975 | Volkert ..... 229/301 |
| 4,284,230 | A | * | 8/1981 | Schultz ..... 229/305 |
| 4,524,903 | A | | 6/1985 | Vath |
| 4,651,920 | A | * | 3/1987 | Stenner ..... 229/70 |
| 4,927,072 | A | | 5/1990 | Jenkins et al. |
| 4,928,875 | A | | 5/1990 | Hutchinson |
| 5,125,562 | A | | 6/1992 | Bendel |
| 5,169,060 | A | * | 12/1992 | Tighe et al. ..... 229/301 |
| 5,174,493 | A | * | 12/1992 | File ..... 229/301 |
| 5,201,464 | A | * | 4/1993 | File ..... 229/305 |
| 5,288,014 | A | * | 2/1994 | Meyers et al. ..... 229/304 |
| 5,289,972 | A | * | 3/1994 | Sauerwine et al. ..... 229/303 |
| 5,346,123 | A | | 9/1994 | Lombardo |
| 5,370,302 | A | | 12/1994 | Dyer |
| 5,375,764 | A | | 12/1994 | Sauerwine |
| 5,376,048 | A | | 12/1994 | Whiteside |

(Continued)

*Primary Examiner* — Nathan J Newhouse
*Assistant Examiner* — Derek Battisti
(74) *Attorney, Agent, or Firm* — Hanley, Flight & Zimmerman, LLC

(57) ABSTRACT

Mailer forms having return mail pieces are described herein. An example form to be folded as an outgoing mailer includes a sheet having substantially parallel top and bottom edges, and substantially parallel first and second side edges, where the first and second side edges are substantially perpendicular to the top and bottom edges. The form includes a first fold line substantially parallel to a second fold line to allow the sheet to fold as an outgoing mailer. A perforation divides the sheet into a removable portion and a reply portion. The form 102 also includes a third fold line different from the first and second fold lines to form a reply mail piece when the removable portion is detached from the sheet and the reply portion is folded along the third fold line. The perforation and the third fold line are substantially parallel to the first and second fold lines.

23 Claims, 8 Drawing Sheets

U.S. PATENT DOCUMENTS 5,402,934 A * 4/1995 Sauerwine ..... 229/303
5,421,620 A 6/1995 Sauerwine
5,425,500 A * 6/1995 Sauerwine ..... 229/303
5,513,795 A * 5/1996 Sauerwine ..... 229/305
5,553,774 A * 9/1996 Goodno ..... 229/303
5,622,390 A 4/1997 Jenkins
5,626,370 A 5/1997 Petkovsek
5,642,855 A * 7/1997 Michlin ..... 229/305
5,667,134 A 9/1997 Olson et al.
5,713,511 A * 2/1998 Diamond ..... 229/302
5,752,647 A 5/1998 Schubert et al.
5,950,909 A * 9/1999 Peterson et al. ..... 229/92.1
5,961,151 A 10/1999 Tung et al.
6,003,760 A 12/1999 Abercrombie
6,019,280 A 2/2000 Peterson
6,123,253 A 9/2000 Mehta et al.
6,126,064 A 10/2000 Hutchinson
6,129,389 A 10/2000 Younger
6,135,506 A 10/2000 Chess et al.
6,196,453 B1 * 3/2001 Hutchinson ..... 229/305
6,412,687 B1 7/2002 Steitz
6,422,938 B1 7/2002 Steitz
6,431,437 B1 * 8/2002 Lombardo et al. ..... 229/305
6,557,748 B2 5/2003 Bethke
7,083,079 B2 8/2006 Bethke
7,219,828 B2 5/2007 Lombardo
7,669,389 B2 * 3/2010 Butler ..... 53/460
2004/0174013 A1 9/2004 Dyer
2005/0252955 A1 * 11/2005 Sugai et al. ..... 229/92.3
2006/0032896 A1 2/2006 Bethke et al.
2007/0000978 A1 1/2007 Bethke
2008/0060240 A1 * 3/2008 Crum ..... 40/600
2010/0102108 A1 4/2010 Dyer

* cited by examiner

MAILER FORMS FOR FORMING OUTGOING MAILERS HAVING AN INTEGRATED RETURN MAIL PIECE

FIELD OF THE DISCLOSURE

The present disclosure relates generally to mailer forms and, more particularly, to mailer forms for forming outgoing mailers having an integrated return mail piece.

BACKGROUND

Mailers are commonly used as an effective way to distribute information and often times come in a variety of different configurations. For example, some sample configurations include a reply portion and/or return mail piece such as, for instance, a return envelope, a return questionnaire, and/or a detachable portion(s) such as, a receipt(s), a coupon(s), etc. Mailers are typically formed from a single sheet of paper or stock and are configured to allow various data, including indicia, to be pre-printed on the form and/or imaged during processing through one of, for example, a printer. Once imaged, the mailer form is typically folded to form a conventional sized letter or envelope that includes an outgoing address and mailed to a recipient. The recipient may be requested to, for example, fill-in a portion of the mailer with information and return the portion via a return mail piece included in the outgoing mailer.

DETAILED DESCRIPTION

Figure 1A:
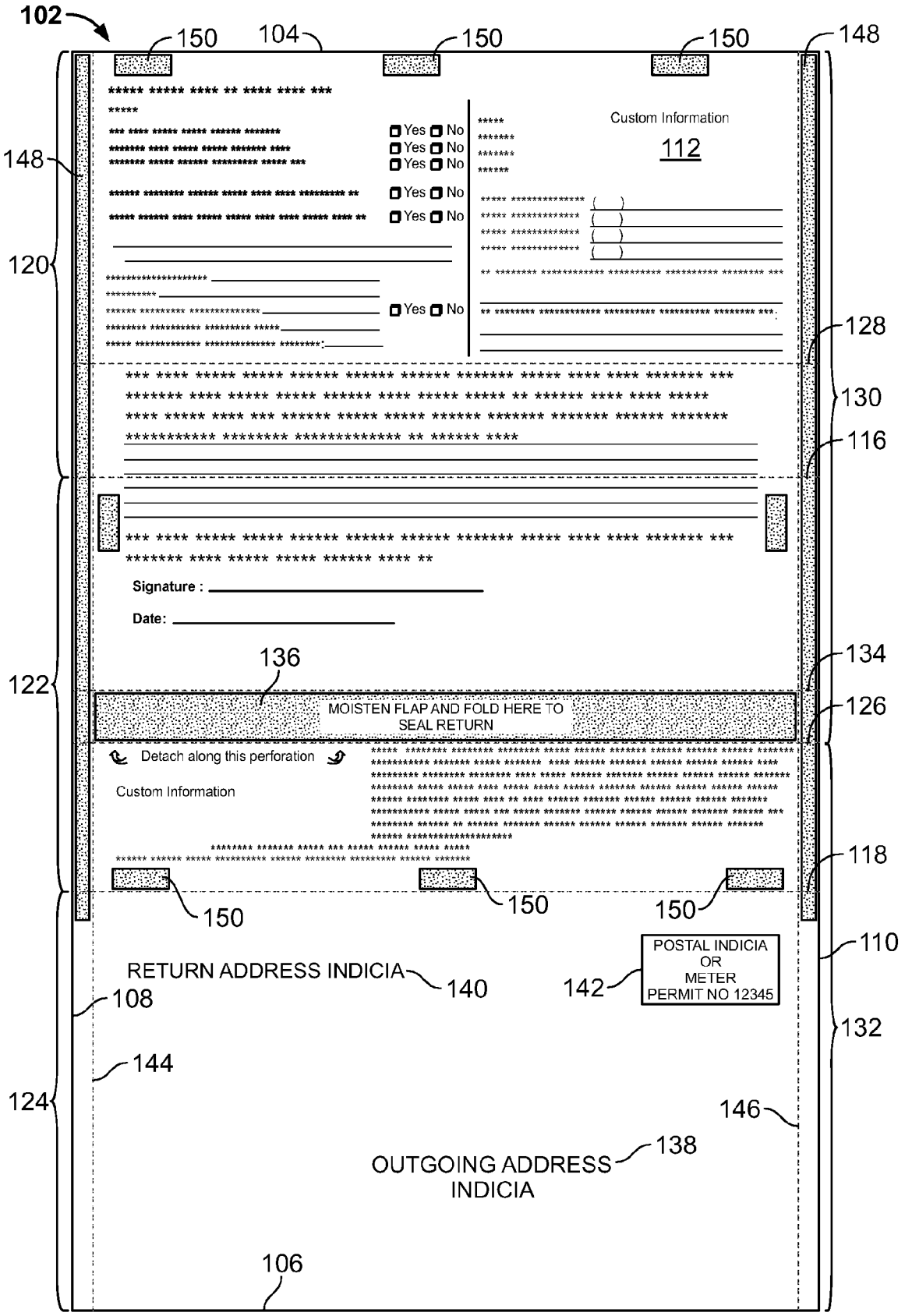
FIG. 1A is a top plan view of an example mailer form showing a first side of the example mailer form as described herein.

Mailers are commonly used as an effective way to distribute information. Mailer forms are typically formed from a single sheet of paper or stock and are configured to accept various data, including indicia, to be pre-printed on the form and/or imaged during processing through use of, for example, a printer. In some examples, the mailer form is folded as an outgoing mailer to form a conventional sized letter or envelope per United States Postal Service (USPS) regulations. USPS regulations require the outgoing mailer and any reply mail piece to have a certain thickness, weight, and/or size so that the mail pieces can travel through postal sorters or other various postal equipment without difficulties.

Outgoing mailers typically include a reply portion such as, for example, a return envelope, and/or detachable portions such as, for example, receipts, coupons, etc., to distribute, disseminate and/or otherwise provide information. For example, a reply envelope may be included with an outgoing mailer to allow the recipient to return a questionnaire and/or other portions as desired. A reply envelope, for example, may include a panel or panels detachable from the outgoing mailer and including a flap to seal or capture the contents (e.g., a questionnaire) to be returned within the reply envelope.

In some examples, a double parallel folded outgoing mailer includes a detachable envelope formed from at least one removable panel. In this instance, the reply portion, such as, for example, a questionnaire, is often imaged (e.g., printed) on an exposed face of the outgoing mailer with information pertaining to the recipient. The example reply envelope is formed by folding the panels along the same fold lines that form the outgoing mailer, but in an opposite or reverse direction in which the outgoing mailer is formed. As a result, the panels are often folded in a manner that exposes the information external to the outgoing mailer or the reply envelope. This is disadvantageous because the outgoing mailer and/or the reply mail piece may include confidential indicia and/or information. Thus, such known mailers expose confidential indicia and/or information when the mailer is folded to form an outgoing mailer and/or a reply mail piece. Therefore, it is desirable for an outgoing mailer to have an integral reply mail piece that is folded in such a way as to conceal confidential indicia in both an outgoing mailer and as a reply piece.

The example mailer forms described herein include a reply mail piece such as, for example, an envelope integrally formed with the mailer form to conceal confidential indicia included in both the outgoing mailer and in the reply mail piece. The example mailer forms described herein are formed from a single sheet of paper. Various or custom indicia may be printed on at least a first or single side of the mailer form via for example, a laser printer, a personal printer, an industrial printer, and/or any other suitable imaging device. Such a configuration advantageously enables a user to print personalized data or information of a particular recipient onto the form and/or the reply mail piece by printing on only one side of the form when the form is fed through, for example, a laser printer. Such personalized or confidential information may include, for example, a recipient's name, account number, and/or other personal or confidential information on the form.

In some examples described herein, the example mailer forms include three panels having an integral reply mail piece (e.g., an envelope or post card) that conceals confidential indicia when assembled as both an outgoing mailer and as a reply mail piece. The outgoing mailer is formed by folding the mailer form along a first fold line parallel to a second fold line in, for example, a Z-fold formation. When received by the recipient, the outgoing mailer may be unfolded or otherwise opened to reveal the contents to the recipient. The example unfolded outgoing mailer may also include a perforation to define and/or divide the mailer form into a reply portion and a removable portion. For example, the removable portion is removed from the reply portion along the perforation and may kept by the recipient as, for example, a receipt.

The reply portion of the example mailer forms is folded along at least a third fold line different from the first and second fold lines that form the outgoing mailer. When folded along the third fold line, the reply portion forms the reply mail piece that the customer may place in the mail (e.g., the United States Postal Service). In at least one example, a first side of the reply portion includes a response portion (e.g., a questionnaire) to be completed by the recipient of the outgoing mailer. In other examples, the reply portion may include confidential indicia, information, etc. A second side of the reply portion may include a preprinted return address and/or appropriate spacing for an address label, a hand written address, or other address indicia. The first side of the reply portion is folded (e.g., hidden) within or inside the outgoing mailer when the mailer form sent to the recipient and is similarly folded (e.g., hidden) within or inside the reply mail piece when the mailer form is returned as a reply mailer. In this manner, the first side of the reply portion may include confidential information and, thus, enable the example mailers to serve as a confidential reply mail piece. Additionally, the outgoing address and the return address are on opposite sides of the mailer form so that when folded as an outgoing mailer in a Z-fold configuration, the return address is not exposed (e.g., the return address faces an inside surface when the mailer form is folded as an outgoing mailer).

The information or indicia in the example mailers described herein may be human and/or machine readable information, which may be pre-printed on the example form, printed on the form when the form is passed through a printer such as, for example, a laser printer, handwritten on the form, provided via a label, and/or any combination thereof.

Figure 1B:
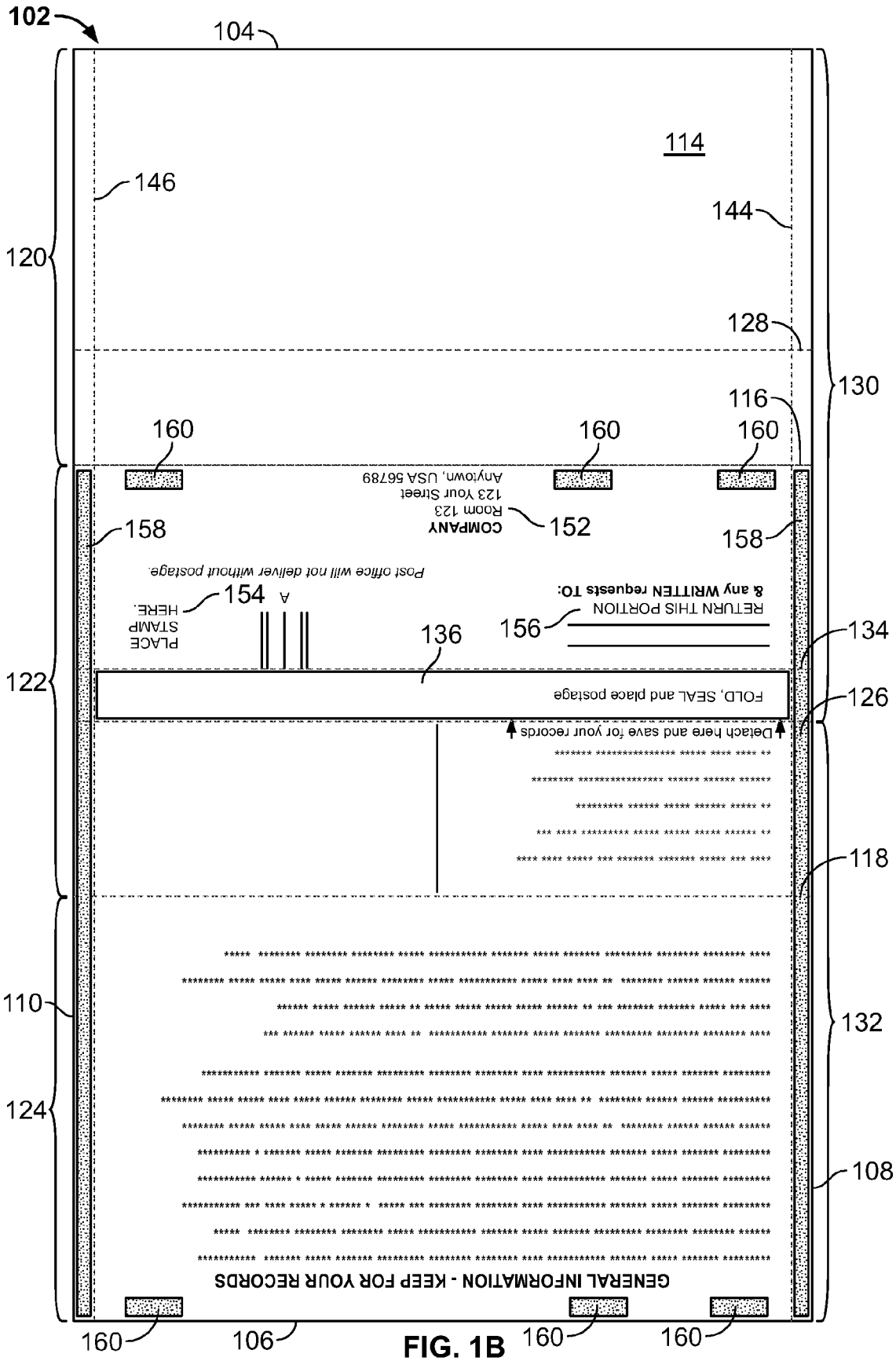
FIG. 1B is a bottom plan view of the example mailer form of FIG. 1A showing a second side of the example mailer form.
Figure 3A:
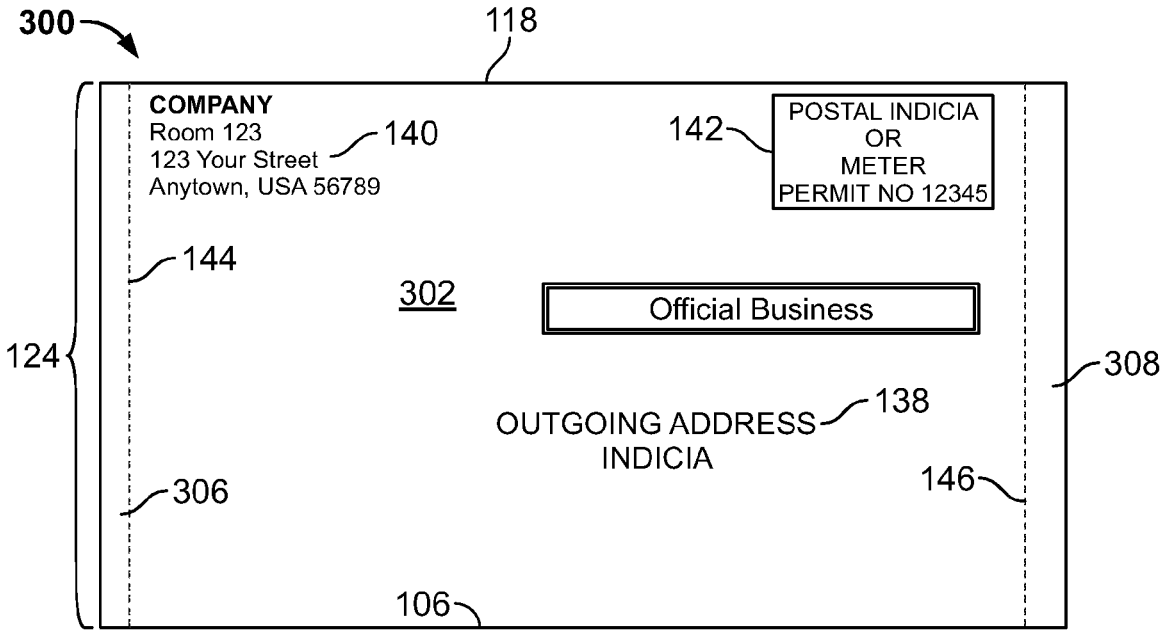
FIG. 3A illustrates a front side of an example outgoing mailer created by folding the example mailer form.
Figure 3B:
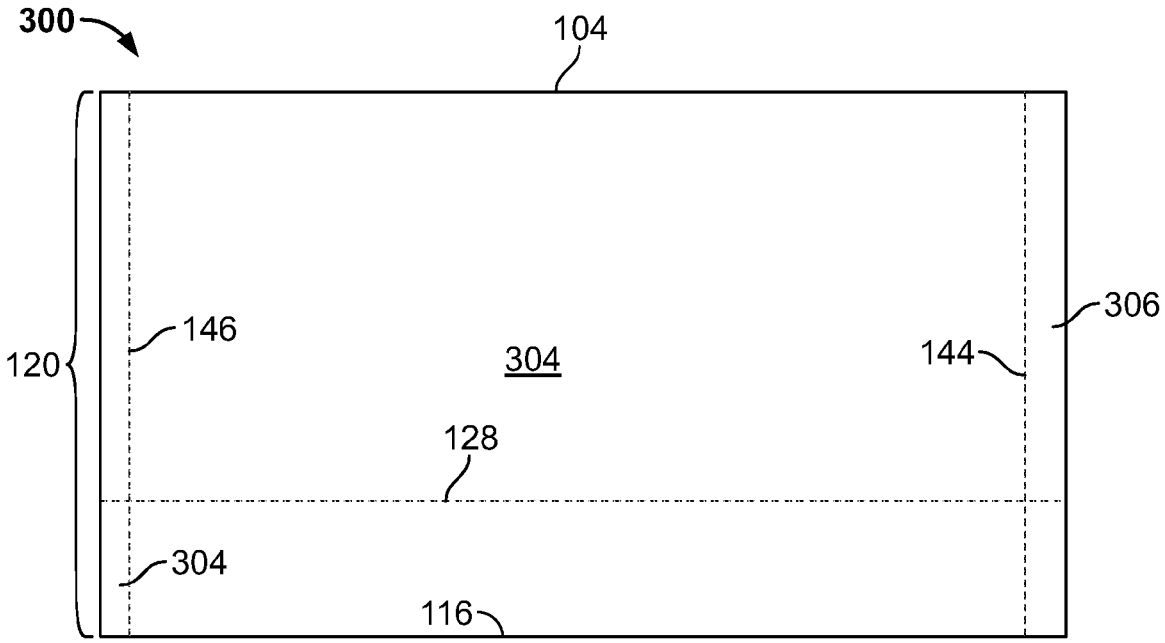
FIG. 3B illustrates a back side of the example outgoing mailer of FIG. 3A.

FIGS. 1A and 1B illustrate an example mailer form 102 described herein. Referring to FIGS. 1A and 1B, the example mailer form 102 is a single sheet of paper having sufficient weight and thickness to meet USPS requirements and regulations (e.g., 0.0035 inches thick) when folded as an outgoing mailer such as, for example, an outgoing mailer 300 as shown in FIGS. 3A and 3B and discussed in further detail below. In one example, the mailer form 102 is 14 inches in length by 8½ inches in width. In other examples, the form 102 may have any other suitable dimensions, weights, and/or sizes.

The example form 102 includes a top edge 104 and a bottom edge 106, and parallel first and second side edges 108, 110, respectively. In this example, the top and bottom edges 104, 106 are substantially perpendicular to the side edges 108, 110. The form 102 further defines a front face or first side 112 (FIG. 1A) and a back face or second side 114 (FIG. 1B).

The example form 102 has a first fold line 116 and a second fold line 118. The first fold line 116, along with the top edge 104 and the first and second side edges 108, 110, define a first panel 120 of the form 102. The second fold line 118, along with the first fold line 116 and the first and second side edges 108, 110, define a second panel 122 adjacent the first panel 120. A third panel 124 adjacent the second panel 122 is formed by the second fold line 118, the bottom edge 106, and the first and second side edges 108, 110. The first, second, and third panels 120, 122, 124 in combination define the example form 102 prior to folding as the outgoing mailer 300 described below in connection with FIGS. 3A and 3B. The first panel 120 is interconnected with the second panel 122 at the first fold line 116 and the second panel 122 is interconnected with the third panel 124 at the second fold line 118 in a manner that enables the first, second, and third panels 120, 122, 124, to be folded, such as, for example, Z-folded, onto each other to form the outgoing mailer 300 (See FIGS. 3A and 3B).

In this example, the form 102 also has a perforation 126 disposed between the first and second fold lines 116, 118 and a third fold line 128 disposed within the first panel 120 between the first fold line 116 and the top edge 104. The perforation 126, the top edge 104, and the side edges 108, 110 define a reply portion 130. The perforation 126, the bottom edge 106, and the side edges 108, 110 define a removable portion 132. As described in greater detail below in connection with FIGS. 5, 6A, 6B, 7A, and 7B, the example reply portion 130 may be folded along the third fold line 128 to form a reply mail piece such as, for example, a reply mail piece 700 as shown in FIGS. 7A and 7B. Thus, the first and second fold lines 116, 118 allow the sheet to be folded to form an outgoing mailer 300 (e.g., an envelope) and the third fold line 128 allows the reply portion 130 to be folded as the reply mail piece 700 (e.g., an envelope). The form 102 may also include a score line 134 adjacent the perforation 126 to define a flap or seal 136 of the reply mail piece 700 as shown in FIGS. 1A and 1B.

The example fold lines 116, 118, 128 are substantially parallel to the top and bottom edges 104, 106 and extend substantially transverse to, and extend at least partially between the side edges 108, 110 for dividing or forming the form 102 into the three panels 120, 122, 124. Likewise, the perforation 126, and the score line 134 are substantially parallel to the top and bottom edges 104, 106 and extend substantially transverse to, and extend at least partially between the side edges 108, 110 to configure the form 102 to have the return mail piece 700. In this example, the fold lines 116, 118, 128, the perforation 126, and the score line 134 extend substantially the entire distance between the first and second side edges 108, 110 and each of the fold lines 116, 118, 128, the perforation 126, and the score line 134 are substantially continuously formed. In other examples, at least one of the fold lines 116, 118, 128, the perforation 126, or the score line 134 may extend less than the entire distance between the first and second side edges 108, 110 and/or may be formed by at least two colinear fold lines, perforations, and/or score lines. For example, the fold lines 116, 118, 128, the perforation 126, and/or the score line 134 may be discontinuously formed.

In the illustrated example, the first, second, and third panels 120, 122, 124 are substantially the same size (e.g., the same width and length). In other examples, the panels 120, 122, 124 may be any suitable size such that when folded along the first and second fold lines 116, 118, the example form 102 forms an outgoing mailer having a reply portion integrally formed therein. Additionally, the example reply portion 130 is configurable as a reply mail piece such as, for example, the return mail piece 700 as described in connection with FIGS. 7A and 7B. In particular, the example return mail piece 700 is formed when the reply portion 130 is folded along the third fold line 128, which is different from the first and second fold lines 116, 118. In still other examples, the form 102 may include panels configured in any suitable arrangement so that the form 102 may be folded as a double-parallel configuration, a C-fold configuration, and/or any other suitable fold configurations.

With reference to the illustrated example of FIGS. 1A and 1B, the first panel 120 is disposed as the first or top panel of the example form 102. The second panel 122 is disposed as the second or middle panel of the example form 102. The third panel 124 is disposed as the third or bottom panel of the example form 102 so that the second panel 122 is between the first and third panels 120, 124, respectively.

The first, second, and/or third panels 120, 122, 124 may include human and/or machine readable indicia that may be pre-printed on the example form 102, printed when the form 102 is passed through an imaging device such as, for example, a printer, handwritten on the form 102, provided via a label, and/or any combination thereof.

In this example, the first side 112 of the reply portion 130 may include personalized information relating to a particular recipient/customer of the example form 102, confidential, and/or any other suitable information. More specifically, in some examples, the form 102 may be used to distribute jury summons. In this instance, the reply portion 130 may include a questionnaire regarding a recipient's eligibility requirements to serve as a juror. The questionnaire may include blanks for fill-in responses and/or check boxes to simplify the return. The reply portion 130 may also include the recipient's personal information such as, for example, social security number, date of birth, employment, etc. The reply portion 130 may also include instructions for the recipient to list any personal (e.g., confidential) information or reasons why the recipient of the outgoing mailer 300 cannot serve as a juror, reporting instructions, jury administrator contact information, personalized information, custom information, etc. Further yet, the reply portion 130 may include a signature line in which the recipient is to sign prior to returning the questionnaire via the reply mail piece 700.

In still other examples, the information in the reply portion 130 may include pre-printed human or machine readable indicia information such as, for example, a questionnaire, instructions, a survey, request for promotional discounts or rebates, purchase request, merchandise rebate information, etc, or may be left blank. More specifically, in one example, the reply portion 130 may include extended warranty information, a request for additional information relating to the extended warranty, and/or a request for information or rebate information of various products purchased by the recipient. Additionally or alternatively, in another example, the reply portion 130 may include personalized information relating to a particular recipient/customer of the example form 102. For example, the reply portion 130 may include truncated credit card information and/or authorization signature line to purchase a product or service such as, for example, mail order promotional merchandise, extended warranty coverage for a purchased item, etc. In other examples, the reply portion 130 may also include the recipient's name, address information, other personal information, and/or a section to correct such information if it is incorrect. Furthermore, the reply portion 130 may include check-off indicia to optimize the possibility that the recipient (the outgoing addressee) will complete and return the reply portion 130 of the form 102.

In the illustrated examples, the first side 112 of the third panel 124 includes human and/or machine readable indicia such as, for example, outgoing address indicia 138 (e.g., recipient's address, postal address bar coding, etc.), return address indicia 140, and postage indicia 142. Alternatively, the outgoing address 138, return address indicia 140, and the postage indicia 142 may receive, for example, a label.

As shown, the example form 102 includes first and second lines of weakness 144, 146 adjacent and substantially parallel to the side edges 108, 110, respectively. In this example, adhesive patterns 148 are disposed in at least a portion of the area between the side edges 108, 110 and the respective lines of weakness 144, 146 for holding the panels 120, 122, 124 together when the form 102 is folded about the fold lines 116, 118 to form the outgoing mailer 300. In this example, the adhesive patterns 148 are a pressure activatable adhesive, however, any other suitable adhesive may be utilized. Additionally or alternatively, the second panel 122 may include an adhesive pattern 150 (e.g., adhesive tabs) adjacent the second fold line 118 and/or adjacent the top edge 104 for holding together the first panel 120 with the second panel 122 when the form 102 is folded as an outgoing mailer 300.

Referring to FIG. 1B, in this example, the removable portion 132 is detachable from the form 102 along the perforation 126 and may be retained and/or otherwise disposed of by the recipient of the outgoing mailer 300. For example, the back side 114 of the removable portion 132 may include preprinted information such as, for instance, a letter, an instruction, a notice, receipt information, personalized information, a coupon, promotional information, and/or any other suitable instructional information. In other examples, the removable portion 132 may be left blank. For example, if the form 102 is to provide jury service information, the back side 114 of the removable portion 132 may include instructions informing the recipient to complete and sign the questionnaire of the reply portion 130, the location of the court, court contact information, deadline or timeframe for responding, parking information, directions to the courthouse, images of maps relating to the directions, and/or any other suitable information. In yet other examples, the back side 114 of the removable portion 132 may include a gift receipt, a gift card, a coupon, an informational display, sweepstakes, or any suitable information. In yet other examples, the removable portion 132 may be a rebate stub, a coupon, etc., detachable from the removable portion 132 along the fold line 118 and the perforation 126 to be kept and/or disposed of by the recipient as a receipt. Additionally or alternatively, the removable portion 132 may include personalized information tailored for each recipient that is to receive the example mailer 300. Such information may include, for example, a customer name, an item name and model number of the purchased item, a date of purchase, a method of payment, a rebate amount, a date the rebate was paid, and/or any other suitable personalized information. In yet other examples, the removable portion 132 may be returned via the reply mail piece 700. For example, the second side 114 of the third panel 124 may include an order form, a request for credit card information, etc., that is to be returned via the reply mail piece 700.

In this example, the second side 114 of the second panel 122 includes a reply address indicia 152 (e.g., address bar code information, etc.), postage indicia 154, return address indicia 156, and/or any other suitable indicia or information. Additionally or alternatively, the first panel 120 may include instructional information, any other suitable information, or may be left blank. The flap 136 may include preprinted indicia to instruct the recipient to fold the flap 136 along the score line 134. Additionally, the form 102 may include instructions to the recipient to detach the removable portion 132 along the perforation 126.

Similar to the first side 112, the second side 114 of the illustrated example includes adhesive patterns 158 (e.g., pressure activatable adhesive) at least partially disposed in the area between the side edges 108, 110 and the respective lines of weakness 144, 146 for holding the panels 120, 122, 124 together when the form 102 is folded about the fold lines 116, 118 to form the outgoing mailer 300. Additionally or alternatively, adhesive patterns 160 (e.g., adhesive tabs) may be disposed adjacent the bottom edge 106 and/or the fold line 116 to hold the third panel 124 with the second panel 122 when the form 102 is folded as an outgoing mailer 300.

The adhesive patterns 148, 150, 158, and/or 160 may be any suitable adhesive including for example, a pressure activatable adhesive. By utilizing a pressure activated adhesive, the example form 102 may be processed through a typical office printer without having the adhesive impair or damage the printer because the rollers of an office printer typically do not apply sufficient pressure to the form 102 to activate the adhesive. When folded via, for example, a folding machine, the folded form 102 is passed through a roller or other pressure applying device, which applies sufficient pressure to activate the adhesive on the adhesive patterns 148, 150, 158, and/or 160 to secure or hold the folded form 102 as the example outgoing mailer 300 shown in FIGS. 3A and 3B. In other examples, the adhesive patterns 148, 150, 158, and/or 160 may include a variety of different adhesives such as, for example, heat activated adhesive, and/or any other suitable adhesive or chemical fastening substance(s).

The example fold lines 116, 118, 128, the perforation line 126, the score line 134, and/or the lines of weakness 144, 146 may be any suitable type line, including, for instance, fold lines, lines of weakness, perforation lines, die cut lines, scores, creases, etc., to facilitate folding the example form 102 as the outgoing mailer 300, to facilitate folding the reply portion 130 as the reply mail piece 700, and/or to allow for the removal of the removable portion 132 by a recipient of the form 102. Furthermore, the example form 102 described herein is not limited to the described series and orientations of panels, and may be reversed or changed in any suitable manner. The indicia or information on the first, second, or third panels 120, 122, 124 can be inverted, rotated, altered, or otherwise changed from the orientation shown.

Figure 2:
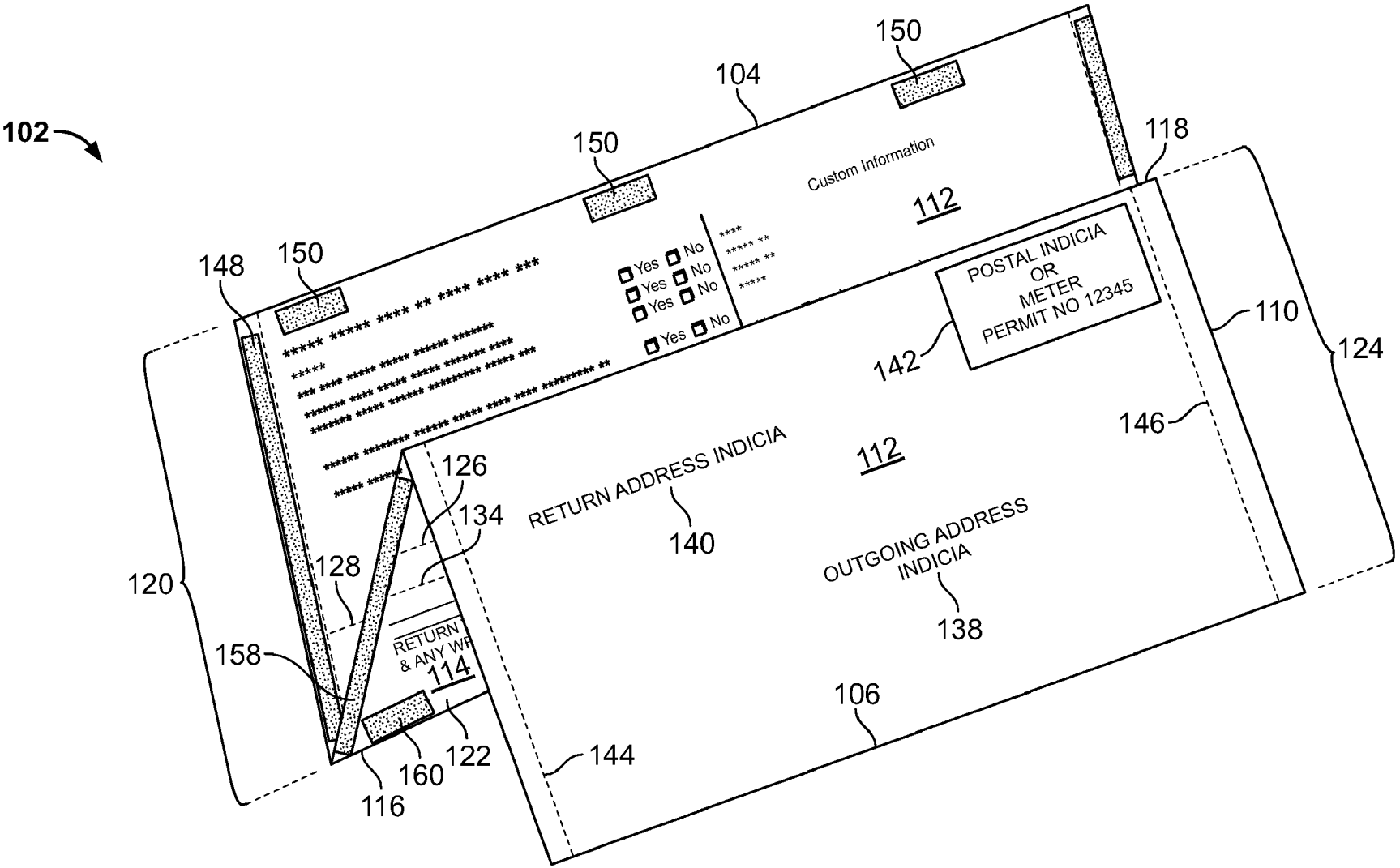
FIG. 2 illustrates the example mailer form of FIGS. 1A and 1B folded along a first fold line and a second fold line.

Referring now to FIG. 2, the example form 102 is shown being folded about the first and second fold lines 116, 118 in a Z-fold configuration or formation. As shown, when the example form 102 is folded about the first fold line 116, the first side 112 of the first panel 120 is folded onto the first side 112 of the second panel 122. Likewise, when the example form 102 is folded about the second fold line 118, the second side 114 of the second panel 122 folds onto the second side 114 of the third panel 124. In this manner, the first side 112 of the first panel 120 (e.g., the questionnaire) and the first side 112 of the second panel 122 are arranged within the example outgoing mailer 300 so that confidentiality and show-through protection is provided. Additionally, the second side 114 of the second panel 122 and the second side 114 of the third panel 124 are arranged within the example outgoing mailer 300, also providing confidentially and see-through protection of the information disposed thereon.

Also, the adhesive patterns 148, 158 hold or secure the form 102 as the outgoing mailer 300 when the form 102 is folded along the fold lines 116, 118. In the illustrated example, the adhesive patterns 148, 158 are a permanent and/or semi-permanent adhesive such as a pressure seal adhesive, cohesive, and/or any other suitable fastening substance. In the illustrated example, the adhesive patterns 148, 158 are substantially continuous to preclude delamination of the outgoing mailer 300. However, in other examples, the adhesive patterns 148, 158 may be provided as a plurality of discontinuous elements and/or may be disposed in any suitable pattern, shape, or density.

Additionally, as noted above, in this example, to provide additional security to hold the panels 120, 122, 124 together as the example outgoing mailer 300, the form 102 include the adhesive patterns 150, 160. The adhesive patterns 150, 160 are shown as tabs having, for example, pressure activated adhesive for holding the form 102 together when the form 102 is folded as the example outgoing mailer 300. The adhesive is of the type and/or is placed in a pattern so that the panels 120, 122, 124 that are held together by the tacking adhesive may be readily separated without significantly destroying the panels 120, 122, 124. In other examples, the adhesive patterns 150, 160 may include adhesive strips, adhesive spots, and/or any other suitable adhesive or chemical fastening substance.

Turning to FIGS. 3A and 3B, the form 102 of FIGS. 1A, 1B, and 2 is illustrated as the example outgoing mailer 300 when the form 102 is folded along the fold lines 116, 118 in a Z-fold formation. The example outgoing mailer 300 includes a first side or front face 302 and a second side or back face 304. When the example form 102 is folded as the outgoing mailer 300, the first side 112 of the third panel 124 forms the front face 302 of the outgoing mailer 300 and the second side 114 of the first panel 120 forms the back face 304 of the outgoing mailer 300. The first side 112 of the first panel 120 and the second panel 122 are folded within the outgoing mailer 300, and in this instance, at least partially hidden from view. Also, the second side 114 of the second panel 122 is folded onto the second side 114 of the third panel 124 within the outgoing mailer 300 so that the reply address indicia 152, the postage indicia 154, and the return address indicia 156 are at least partially hidden from view.

In this example, the area between the lines of weakness 144, 146 adjacent the respective side edges 108, 110 define tear off strips 306, 308 when the example form 102 is folded as the outgoing mailer 300. As noted above, in this example, the area between the side edges 108, 110 and the lines of weakness 144, 146 includes pressure activated adhesive that holds the outgoing mailer 300 together. The strips 306, 308 may also prevent and/or deter unauthorized tampering of the outgoing mailer 300. The outgoing mailer 300 is sent and delivered to the recipient indicated in the outgoing addressee indicia 152 on the third panel 124 via USPS or any other suitable delivery service.

Figure 4:
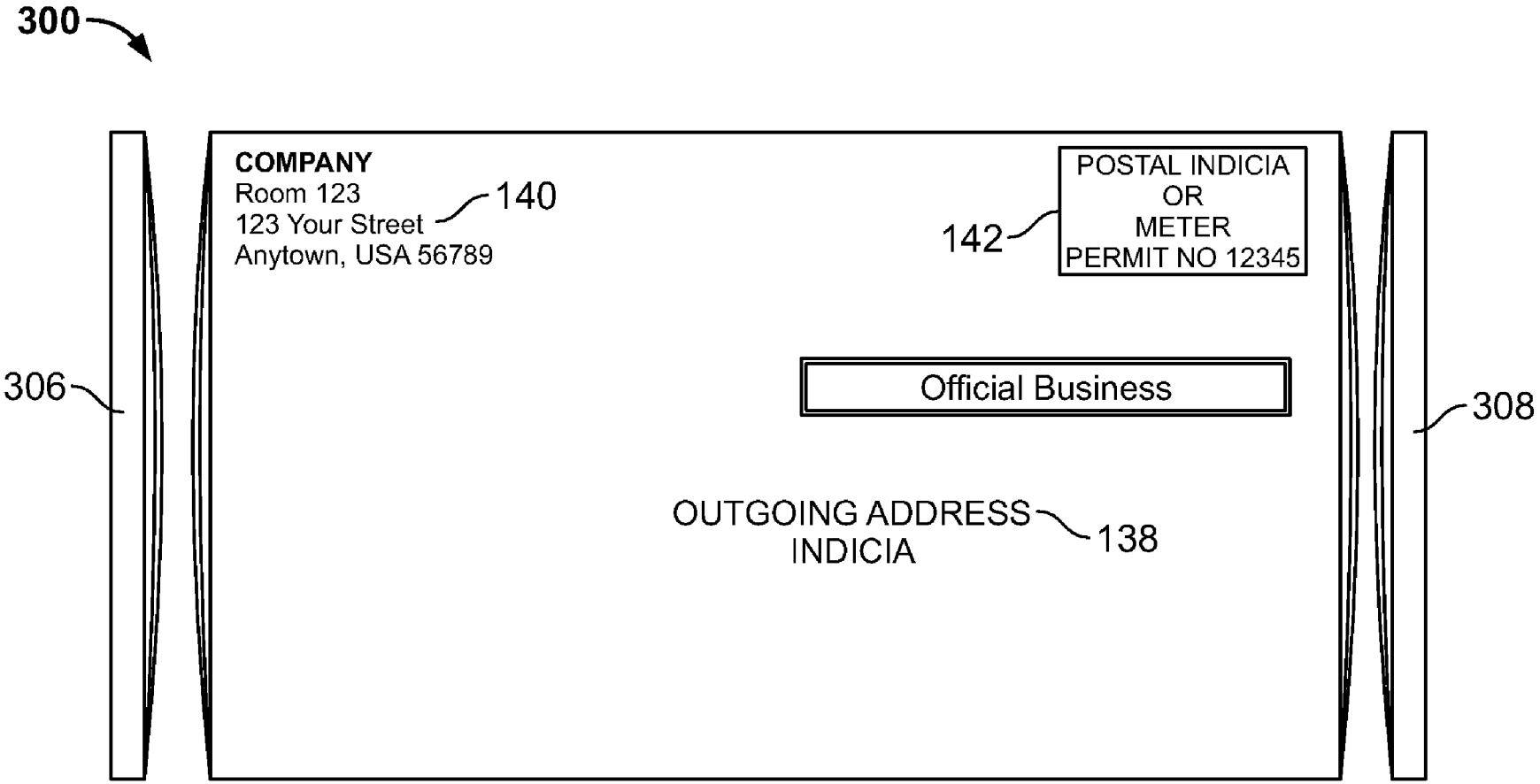
FIG. 4 illustrates the example outgoing mailer of FIGS. 3A and 3B showing example tear-off strips removed.

Referring to FIG. 4, the example outgoing mailer 300 is opened by removing the tear-off strips 306, 308. For example, a recipient may rip the tear-off strips 306, 308 along the lines of weakness 144, 146. The outgoing mailer 300 may be opened (e.g., unfolded) by using, for instance, a finger, a pencil, a letter opener, or otherwise by disrupting the adhesive patterns (e.g., adhesive tabs) 150, 160. The first panel 120 may then be detached from the second panel 122 and the third panel 124 from the second panel 122 with minimal damage to the panels 120, 122, 124. Other methods and/or steps may be utilized to open the outgoing mailer 300 as desired.

Figure 5:
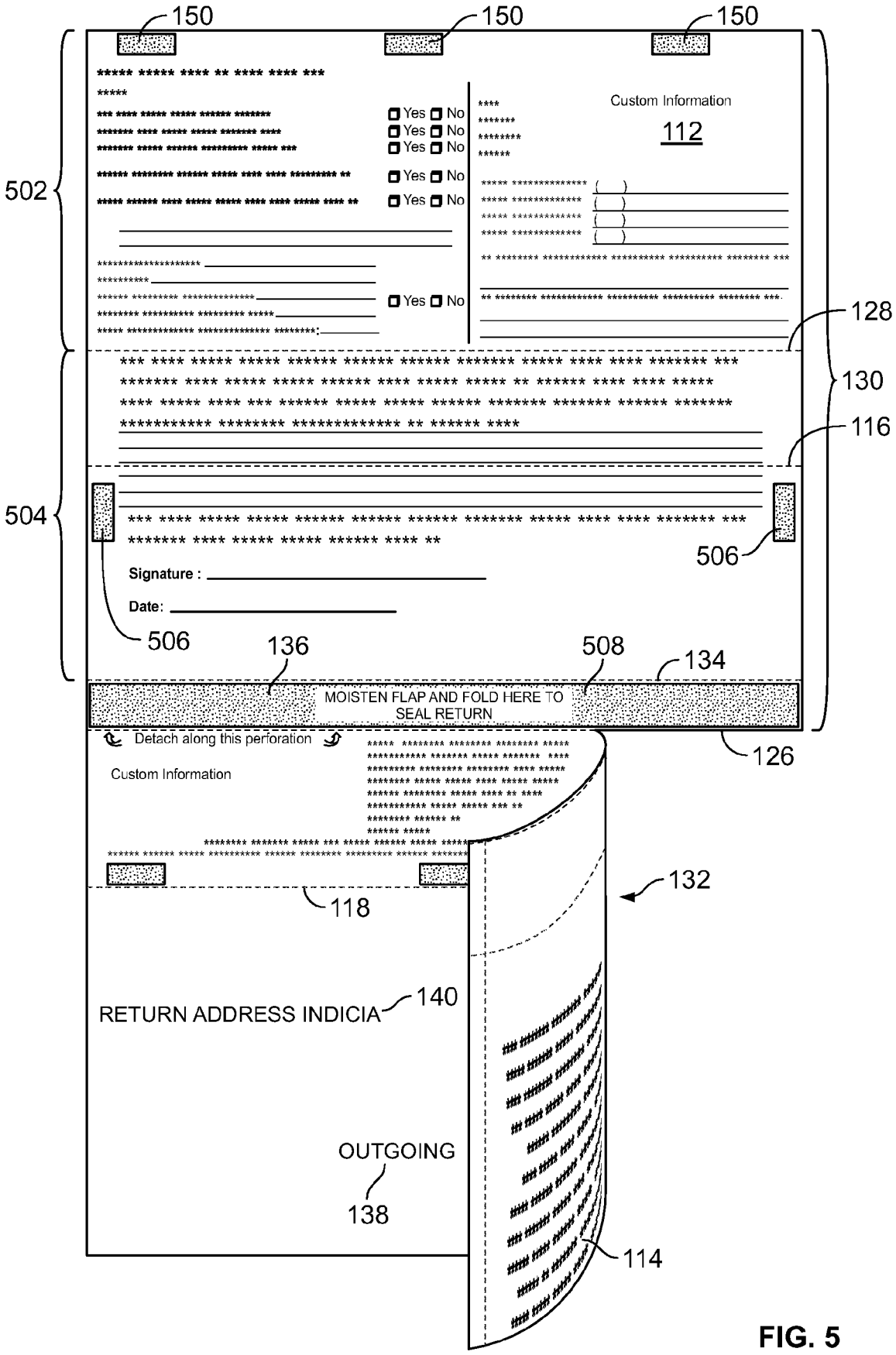
FIG. 5 illustrates a first side of the example outgoing mailer of FIGS. 3A, 3B, and 4 when the mailer is unfolded along the first folding line and showing a removable portion being removed from the example outgoing mailer.

FIG. 5 illustrates the example outgoing mailer 300 when the outgoing mailer 300 is unfolded along the first and second fold lines 116, 118. As shown in FIG. 5, the removable portion 132 may be detached and/or removed from the reply portion 130 along the perforation 126. In this example, the recipient may keep or otherwise dispose of the removable portion 132 as desired. Once the reply portion 130 has been separated from the removable portion 132, the reply portion 130 may be folded to form the reply mail piece 700. In particular, as described above, the third fold line 128 defines or divides the reply portion 130 into a first reply panel 502 and a second reply panel 504. In other words, the first reply panel 502 and the second reply panel 504 are interconnected by the third fold line 128. The first reply panel 502 is folded onto the second reply panel 504 when the reply portion 130 is folded along the third fold line 128 to form the example reply mail piece 700, thereby providing confidentially and show-through protection of the indicia on the first side 112 of the first and second reply panels 502 and 504. Thus, the reply portion 130 may include confidential information. Additionally, as noted above, the first side 112 of the first panel 120 is folded onto the first side 112 of the second panel 122 when the form 102 is folded as an outgoing mailer 300. Thus, any information, including confidential information, included in the first and second panels 120, 122 and/or the reply portion 130 is hidden from view providing confidentiality and show-through protection when the form 102 is folded as the outgoing mailer 300 and the when the reply portion 130 is folded as a reply mail piece 700.

Additionally or alternatively, the example form 102 includes adhesive patterns 506 (e.g., adhesive tabs) adjacent the respective lines of weakness 144, 146 for holding the first reply panel 502 together with the second reply panel 504 when the reply portion 130 is folded as a reply mail piece 700. The flap 136 may also include an adhesive pattern 508 to seal or hold together the flap 136 with the second side 114 (FIG. 6B) of the first reply panel 502 when the reply portion 130 is folded as a reply mail piece 700. The example adhesive patterns 506, 508 may include rewettable adhesive, pressure sensitive adhesive, and/or any other suitable adhesive. Additionally or alternatively, the adhesive patterns 506, 508 may include rewettable adhesive so that the adhesive can be activated to hold the reply portion 130 as a reply mail piece 700 when the form 102 is folded along the third fold line 128.

Figure 6A:
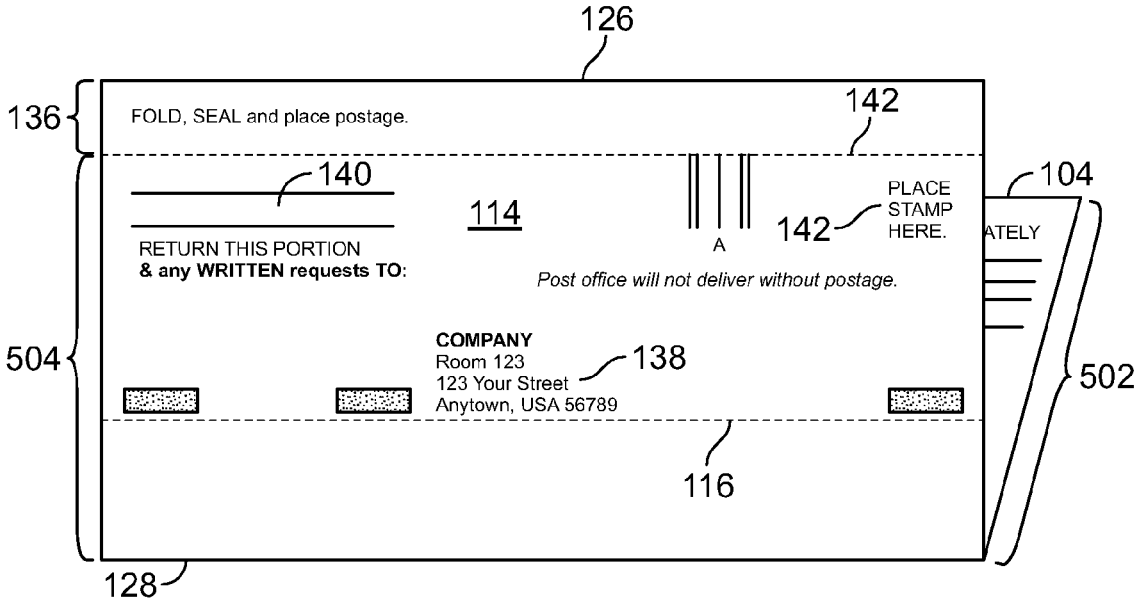
FIGS. 6A and 6B illustrate a first and second side of the example outgoing mailer of FIGS. 3A, 3B, 4, and 5 folded along a third fold line to form a reply mail piece.
Figure 6B:
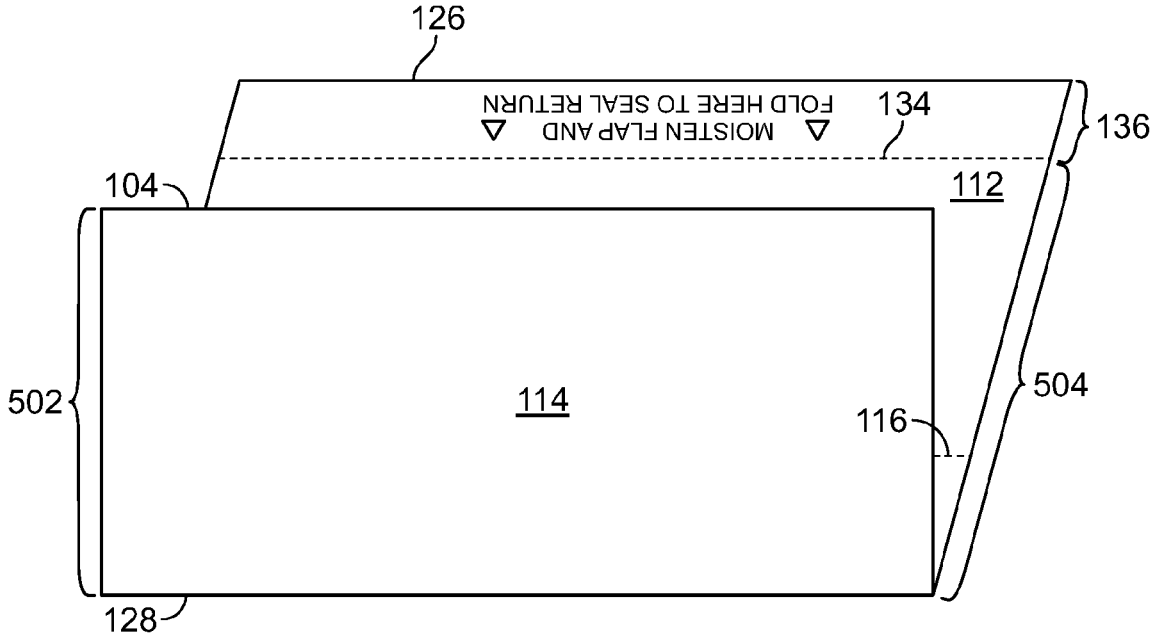
Figure 7A:
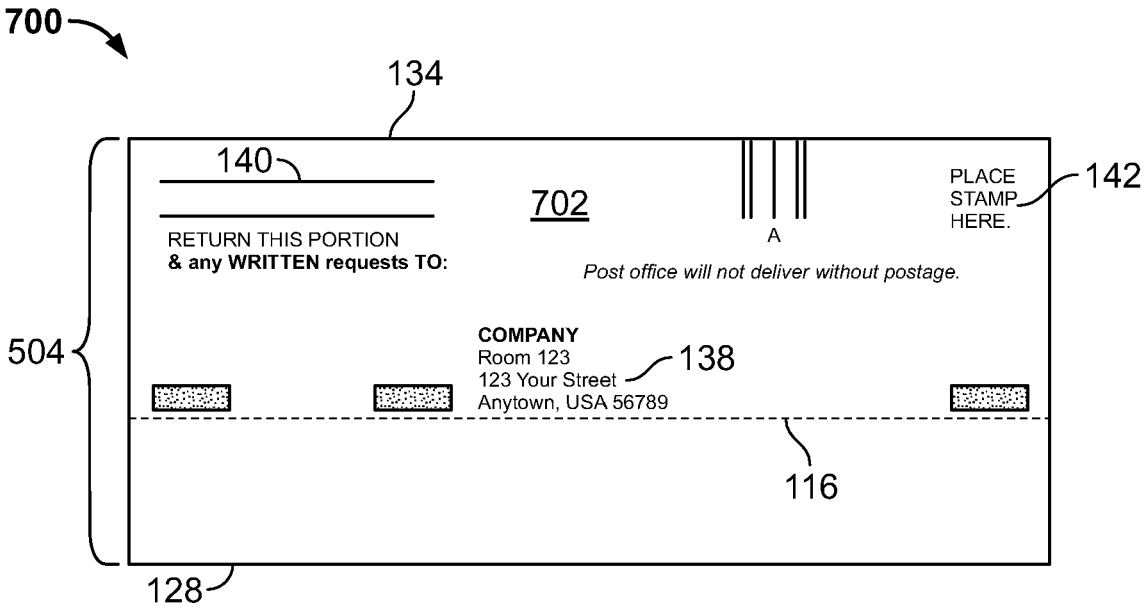
FIGS. 7A and 7B illustrate a first side and a second side of the reply mail piece of FIGS. 6A and 6B folded along the third fold line.
Figure 7B:
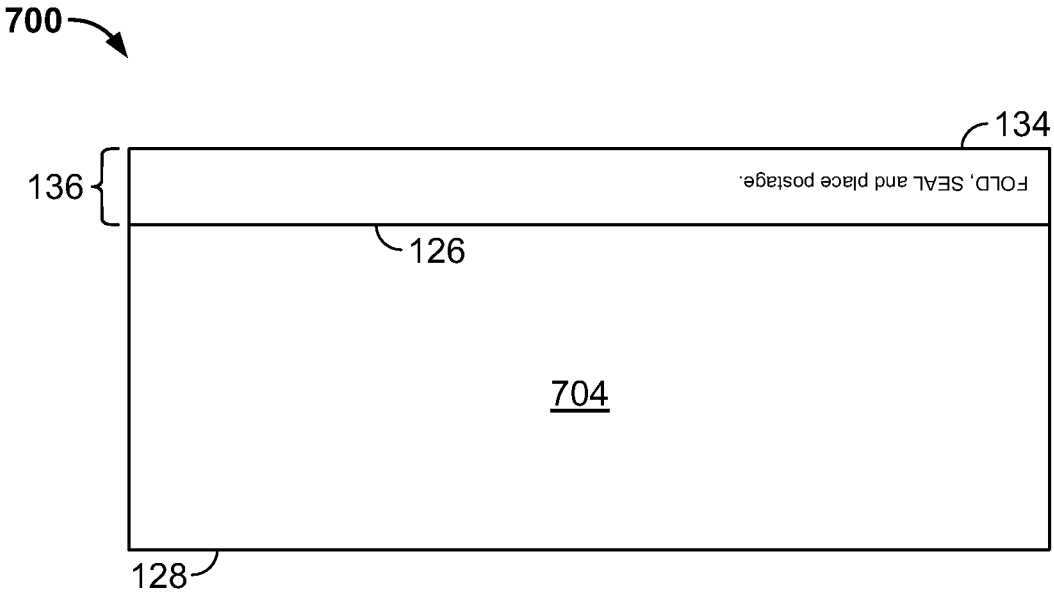

FIGS. 6A and 6B illustrate the example reply portion 130 being folded along the third fold line 128 to form the example reply mail piece 700. For example, the illustrated reply portion 130 is folded along the third fold line 128, as shown in FIGS. 6A and 6B. When folded along the third fold line 128, the first reply panel 502 is folded onto the second reply panel 504. In this manner, the indicia on the first reply panel 502 and the indicia on the second reply panel 504 are folded onto each other and, thus, in this instance, at least partially hidden from view. The flap 136 (if present) may be folded along the score line 134 so that the adhesive pattern 508 of the flap 136 is folded onto the first reply panel 502. Additionally, in this example, the adhesive patterns 506, 508 (e.g., rewettable adhesive) seal or hold together the first reply panel 502 onto the second reply panel 504 when the reply portion 130 is folded along the perforation 126 to form the return mail piece 700.

FIGS. 7A and 7B illustrate the first side or front face 702 and the second side or back face 704 of the reply mail piece 700. In this example, the example return mail piece 700 is depicted as an envelope. However, in other examples, the reply mail piece 700 may be a business reply, a postcard, a courtesy reply, and/or may be configured as any other suitable reply mail piece. The reply mail piece 700 may be deposited with the USPS and/or any other suitable delivery service and delivered to the reply address indicia 152. The example reply mail piece 700 complies with current USPS requirements because the weight and thickness of the return mail piece 700 is sufficient for current postal machine processing.

Although certain example apparatus and articles of manufacture have been described herein, the scope of coverage of this patent is not limited thereto. On the contrary, this patent covers all apparatus and articles of manufacture fairly falling within the scope of the appended claims either literally or under the doctrine of equivalents.

What is claimed is:

1. A form comprising:

a sheet having substantially parallel top and bottom edges, and substantially parallel first and second side edges, wherein the first and second side edges are substantially perpendicular to the top and bottom edges;

a first line of weakness substantially parallel to a second line of weakness to allow the sheet to fold as an outgoing mailer;

a third line of weakness located between the first and second lines of weakness to divide the sheet into a removable portion and a reply portion; and a fourth line of weakness different from the first and second lines of weakness to form a reply mail piece when the removable portion is detached from the sheet and the reply portion is folded along the fourth line of weakness, wherein the third line of weakness and the fourth line of weakness are substantially parallel to the first and second lines of weakness.

2. A form as described in claim 1, wherein the form is folded along the first and second lines of weakness in a Z-fold configuration to form the outgoing mailer.

3. A form as described in claim 1, further comprising a fifth line of weakness substantially parallel and adjacent the third line of weakness to form a sealing flap of the reply mail piece.

4. A form as described in claim 3, further comprising a first adhesive pattern disposed between the third line of weakness and the fifth line of weakness.

5. A form as described in claim 1, wherein the first and second lines of weakness are substantially parallel to the top and bottom edges and extend at least partially between the first and second side edges to define a first panel, a second panel, and a third panel of the outgoing mailer, wherein the first, second, and third panels are folded along the first and second lines of weakness to form the outgoing mailer.

6. A form as described in claim 5, wherein when folded as an outgoing mailer, the front face of the third panel forms a front side of the outgoing mailer and the back face of the first panel forms a back side of the outgoing mailer.

7. A form as described in claim 5, wherein a portion of the front face of the first panel and a front face of the second panel includes a second adhesive pattern and the back face of the second panel and the back face of the third panel includes a third adhesive pattern for holding the form together when folded as an outgoing mailer.

8. A form as described in claim 5, wherein when folded as a reply mail piece, a first portion of the back face of the first panel forms a back side of the reply mail piece, and wherein a second portion of the back face of the first panel and a first portion of the back face of the second panel form a front side of the reply mail piece.

9. A form as described in claim 1, further comprising sixth and seventh lines of weakness adjacent and substantially parallel to the first and second side edges.

10. A form as described in claim 9, wherein the sixth line of weakness and the first side edge and the seventh line of weakness and the second side edge define first and second tear-off strips, respectively, when the form is folded as an outgoing mailer.

11. A form as described in claim 10, further comprising a third adhesive area between the first side edge and the sixth line of weakness and the second side edge and the seventh line of weakness.

12. A form as described in claim 1, wherein the first line of weakness is located between the second line of weakness and the top edge, wherein the fourth line of weakness is located between the first line of weakness and the top edge.

13. A form, comprising:

a first panel, a second panel, and a third panel, defining a sheet prior to folding the form, the first panel and the second panel being interconnected at a first fold line, and the second panel and the third panel being interconnected at a second fold line in a manner that enables the first, second, and third panels to be folded onto each other along the first and second fold lines to form an outgoing mailer, wherein the first and second fold lines are substantially parallel to the top and bottom edges;

a first line of weakness disposed between the first and second fold lines and within the second panel to define a reply portion of the form and a removable portion of the form, wherein the first line of weakness is substantially parallel to the top and bottom edges; and a third fold line adjacent the first fold line and disposed within the first panel, wherein the third fold line defines a first reply panel and a second reply panel interconnected at the third fold line, and wherein the third fold line enables the first reply panel to fold onto the second reply panel to form a reply mail piece when the removable portion is detached from the form, and wherein the third fold line is substantially parallel to the top and bottom edges.

14. A form as described in claim 13, further comprising a second line of weakness substantially parallel to and adjacent the first line of weakness to form a flap of the reply mail piece.

15. A form as described in claim 14, wherein the reply portion is folded along the third fold line to form the reply mail piece such that a back surface of the second reply panel forms a front side of the reply mail piece and a back surface of the first reply panel forms a back side of the reply mail piece.

16. A form as described in claim 15, wherein the flap is folded along the second line of weakness onto the first reply panel to seal the reply mail piece.

17. A form as described in claim 13, wherein the removable portion is to be removed by a recipient of the outgoing mailer.

18. A form as described in claim 13, further comprising an adhesive area having at least one adhesive tab for holding the first reply panel together with the second reply panel when the first reply panel is folded onto the second reply panel to form the reply mail piece.

19. A form as described in claim 13, wherein each of the panels have a front surface and a back surface and each of the panels are substantially the same size.

20. A form as described in claim 13, wherein the front face of the third panel defines a front side of the outgoing mailer and the back face of the first panel defines a back side of the outgoing mailer when the form is Z-folded along the first and second fold lines to form the outgoing mailer.

21. A business form for forming a mailer having a reply mailer integrally formed therein, comprising:

a sheet having a first face opposite a second face, substantially parallel top and bottom edges, and substantially parallel first and second side edges, wherein the first and second side edges are substantially perpendicular to the top and bottom edges;

a first line of weakness extending substantially perpendicular to the side edges and extending at least partially between the first side edge and the second side edge to form a first panel;

a second line of weakness extending substantially perpendicular to the side edges and extending at least partially between the first side edge and the second side edge adjacent to the first line of weakness to form a second panel adjacent the first panel and a third panel adjacent the second panel, wherein the first, second, and third panels are folded along the first and second lines of weakness to form an outgoing mailer;

a third line of weakness extending substantially perpendicular to the side edges and extending at least partially between the first side edge and the second side edge and disposed between the first and second lines of weakness, wherein the third line of weakness and the top edge of the sheet define a reply portion of the sheet and the third line of weakness and the bottom edge of the sheet defines a removable portion of the sheet; and a fourth line of weakness extending substantially perpendicular to the side edges and extending at least partially between the first side edge and the second side edge and disposed between the first line of weakness and the top edge so that the reply portion forms a reply mail piece when folded along the fourth line of weakness when the removable portion is detached from the sheet.

22. A form as described in claim 21, further comprising a fifth line of weakness extending substantially perpendicular to the side edges and extending at least partially between the first side edge and the second side edge and disposed adjacent the third line of weakness to form a flap of the reply mail piece.

23. A form as described in claim 22, wherein the lines of weakness extend substantially the entire distance between the first and second edges.

* * * * *

UNITED STATES PATENT AND TRADEMARK OFFICE

CERTIFICATE OF CORRECTION

PATENT NO. : 8,201,725 B2
APPLICATION NO. : 12/363382
DATED : June 19, 2012
INVENTOR(S) : Michael Clark Dyer It is certified that error appears in the above-identified patent and that said Letters Patent is hereby corrected as shown below:

In the Claims

Column 10, line 56 (claim 13), delete "substantially parallel to the top and bottom edges"

and insert --substantially parallel to top and bottom edges--.

Signed and Sealed this
Thirteenth Day of May, 2014

Michelle K. Lee

Michelle K. Lee
*Deputy Director of the United States Patent and Trademark Office*